US011522324B2

(12) United States Patent
Lin

(10) Patent No.: US 11,522,324 B2
(45) Date of Patent: Dec. 6, 2022

(54) DUAL-DIRECTION CONNECTOR INTERFACE FOR CABLE DEVICES

(71) Applicant: PCT International, Inc., Tempe, AZ (US)

(72) Inventor: Kang Lin, Chandler, AZ (US)

(73) Assignee: PCT International, Inc.

( * ) Notice: Subject to any disclaimer, the term of this patent is extended or adjusted under 35 U.S.C. 154(b) by 95 days.

(21) Appl. No.: 17/166,973

(22) Filed: Feb. 3, 2021

(65) Prior Publication Data

US 2022/0247138 A1 Aug. 4, 2022

(51) Int. Cl.

| | |
|---|---|
| ***H01R 24/54*** | (2011.01) |
| ***H01R 13/502*** | (2006.01) |
| ***H01R 13/11*** | (2006.01) |

(52) U.S. Cl.

CPC ..... *H01R 24/547* (2013.01); *H01R 13/11* (2013.01); *H01R 13/502* (2013.01)

(58) Field of Classification Search

CPC ..... H01R 24/547; H01R 13/11; H01R 13/502
See application file for complete search history.

(56) References Cited

U.S. PATENT DOCUMENTS

| | | | | |
|---|---|---|---|---|
| 5,677,578 | A * | 10/1997 | Tang | H01R 13/701 307/119 |
| 5,756,935 | A * | 5/1998 | Balanovsky | H01R 24/547 200/51.09 |
| 5,914,863 | A * | 6/1999 | Shen | H01R 24/46 361/752 |
| 6,292,371 | B1 * | 9/2001 | Toner, Jr. | H01R 25/006 361/752 |
| 9,065,185 | B2 | 6/2015 | Magnezi et al. | |
| 9,923,319 | B2 * | 3/2018 | Ariesen | H04N 7/104 |
| 10,312,607 | B2 * | 6/2019 | Wilson | H01R 12/515 |
| 2018/0254538 | A1 * | 9/2018 | Palawinna | H01P 5/00 |
| 2019/0103686 | A1 * | 4/2019 | Wilson | H01R 12/515 |
| 2021/0351524 | A1 * | 11/2021 | Chapman | H01R 24/54 |

* cited by examiner

*Primary Examiner* — Abdullah A Riyami
*Assistant Examiner* — Nader J Alhawamdeh
(74) *Attorney, Agent, or Firm* — Thomas W. Galvani, P.C.; Thomas W. Galvani

(57) ABSTRACT

A dual direction connector interface includes a housing having first and second sides transverse to each other, and first and second dielectric bodies carried in the first and second sides, respectively, which have first and second bores formed therethrough, respectively. A conducting pin is carried within the housing. The conducting pin has a head and a shank. The first and second conductive bodies are carried on the head of the conducting pin and have first and second passages, respectively, formed therein for receiving a center conductor of a coaxial cable. The first and second passages are registered with the first and second bores, respectively.

20 Claims, 9 Drawing Sheets

DUAL-DIRECTION CONNECTOR INTERFACE FOR CABLE DEVICES

FIELD

The present specification relates generally to data communication, and more particularly to cable television network devices.

BACKGROUND

In cable television ("CATV") systems, audio, video, and data are distributed and collected through a coaxial cable network. With RF signals in the coaxial cables, that network transmits data both to and from subscribers in downstream and upstream directions. Alternating current ("AC") power, typically at 50 or 60 Hz, may also be passed through the coaxial cables. AC power is useful for powering trunk line amplifiers to increase the power of the RF signals in the network.

Outdoor passive devices, such as multi-taps and splitters, may be connected on the main coaxial line of the network. Such devices usually are contained within an external housing or box to protect the internal components from weather and other environmental conditions. The housing typically includes a base and a faceplate. There are typically two or more connector interfaces on the housing to couple the connectors of coaxial cables to the internal components of the housing. The interfaces have seizure screws which capture and connect the center conductor of the coaxial cable, and the interfaces are in turn connected to the printed circuit board inside the housing.

Because of the small footprint of the housings of these passive devices, tight connections must be made. The seizure screws enable such connections between electrical components. Indeed, use of seizure screw connections allows technicians to install and connect cables through connector interfaces on the top, bottom, or side of the housing, even when those interfaces are oriented at roughly ninety-degrees with respect to the PCB.

Unfortunately, the current design and construction of seizure screw connections provides poor performance at frequencies above 1.2 GHz. An improved design is needed.

SUMMARY

A dual direction connector interface includes a housing having first and second sides transverse to each other, and first and second dielectric bodies carried in the first and second sides, respectively, which have first and second bores formed therethrough, respectively. A conducting pin is carried within the housing. The conducting pin has a head and a shank. The first and second conductive bodies are carried on the head of the conducting pin and have first and second passages, respectively, formed therein for receiving a center conductor of a coaxial cable. The first and second passages are registered with the first and second bores, respectively.

The above provides the reader with a very brief summary of some embodiments described below. Simplifications and omissions are made, and the summary is not intended to limit or define in any way the disclosure. Rather, this brief summary merely introduces the reader to some aspects of some embodiments in preparation for the detailed description that follows.

BRIEF DESCRIPTION OF THE DRAWINGS

Referring to the drawings.

DETAILED DESCRIPTION

Figure 1:
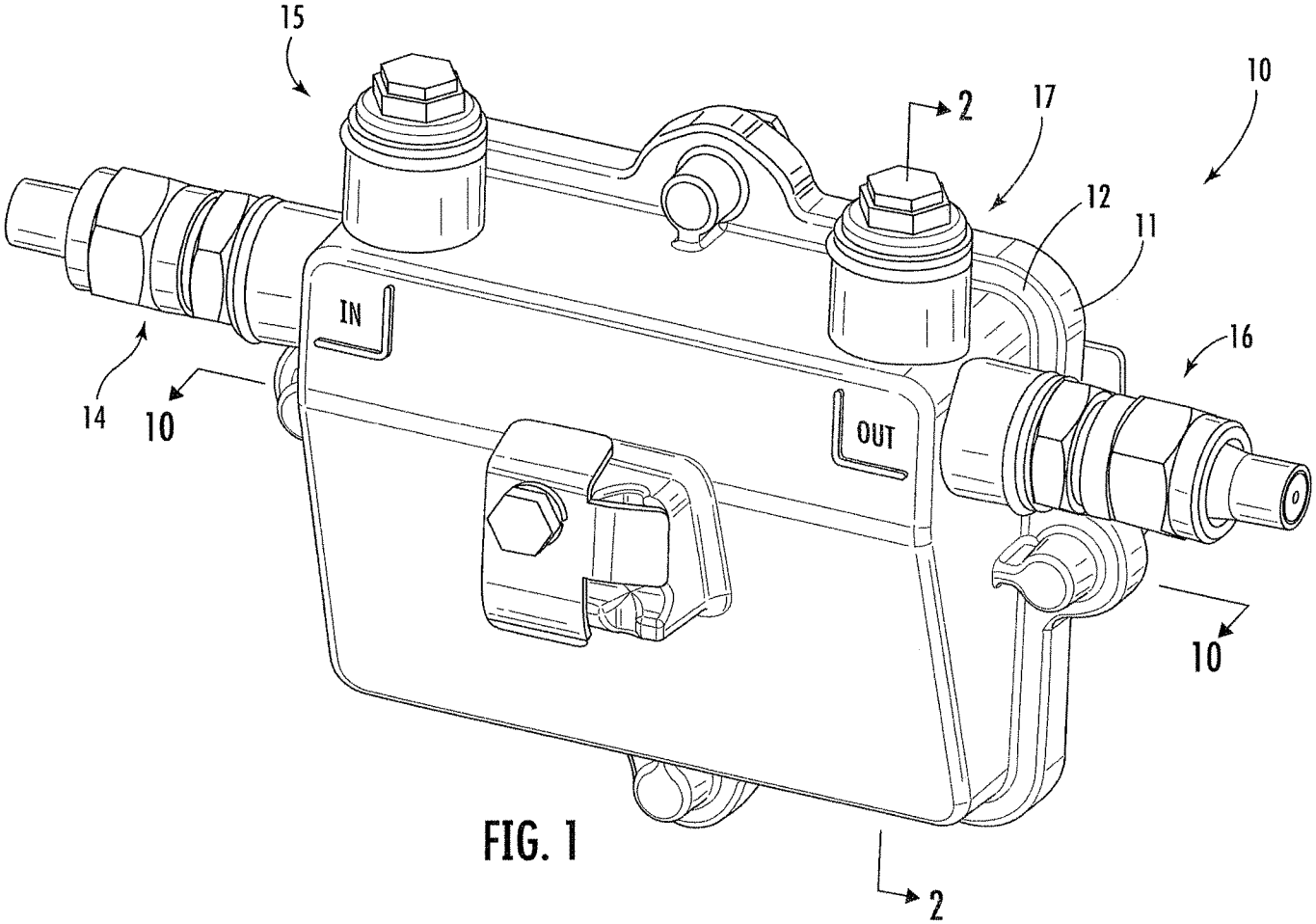
FIG. 1 is a rear perspective view of a housing of a coaxial device containing a dual-direction connector interface for cable devices.

Reference now is made to the drawings, in which the same reference characters are used throughout the different figures to designate the same elements. Briefly, the embodiments presented herein are preferred exemplary embodiments and are not intended to limit the scope, applicability, or configuration of all possible embodiments, but rather to provide an enabling description for all possible embodiments within the scope and spirit of the specification. Description of these preferred embodiments is generally made with the use of verbs such as "is" and "are" rather than "may," "could," "includes," "comprises," and the like, because the description is made with reference to the drawings presented. One having ordinary skill in the art will understand that changes may be made in the structure, arrangement, number, and function of elements and features without departing from the scope and spirit of the specification. Further, the description may omit certain information which is readily known to one having ordinary skill in the art to prevent crowding the description with detail which is not necessary for enablement. Indeed, the diction used herein is meant to be readable and informational rather than to delineate and limit the specification; therefore, the scope and spirit of the specification should not be limited by the following description and its language choices.

FIG. 1 illustrates a housing 10 for a cable network component, such as a tap or a splitter. The housing 10 includes a faceplate 11 and a backplate 12, coupled together to form an environmental seal for preventing ingress of moisture, dirt, and other environmental intrusions into an interior 13 (not shown) of the housing 10. The housing 10 further includes two input connections and two output connections, each pair defining a connection assembly on the housing 10; the input connection assembly or input connections are an aerial input 14 and a transversely-oriented pedestal input 15, and the output connection assembly or output connections are an aerial output 16 and a transversely-oriented pedestal output 17. The connections are suitable for connecting the cable network component in line in the cable network.

The aerial and pedestal inputs 14 and 15 are offset by ninety degrees to each other to allow the technician to more easily connect a cable to the housing 10 without exceeding the bend radius of the cable, thereby damaging the structure of the cable and impeding its performance. Similarly, the aerial and pedestal outputs 16 and 17 are also offset by ninety degrees.

Despite the ninety-degree orientations of the respective input connections and respective output connections, the pedestal and aerial connections thereof are alternately usable; a technician can connect an upstream coaxial cable to either of the aerial and pedestal inputs 14 and 15, and he can connect a downstream coaxial cable to either of the aerial and pedestal outputs 16 and 17. For example, the technician could connect an upstream cable to the aerial input 14 and a downstream cable to the pedestal output 17.

Figure 5:
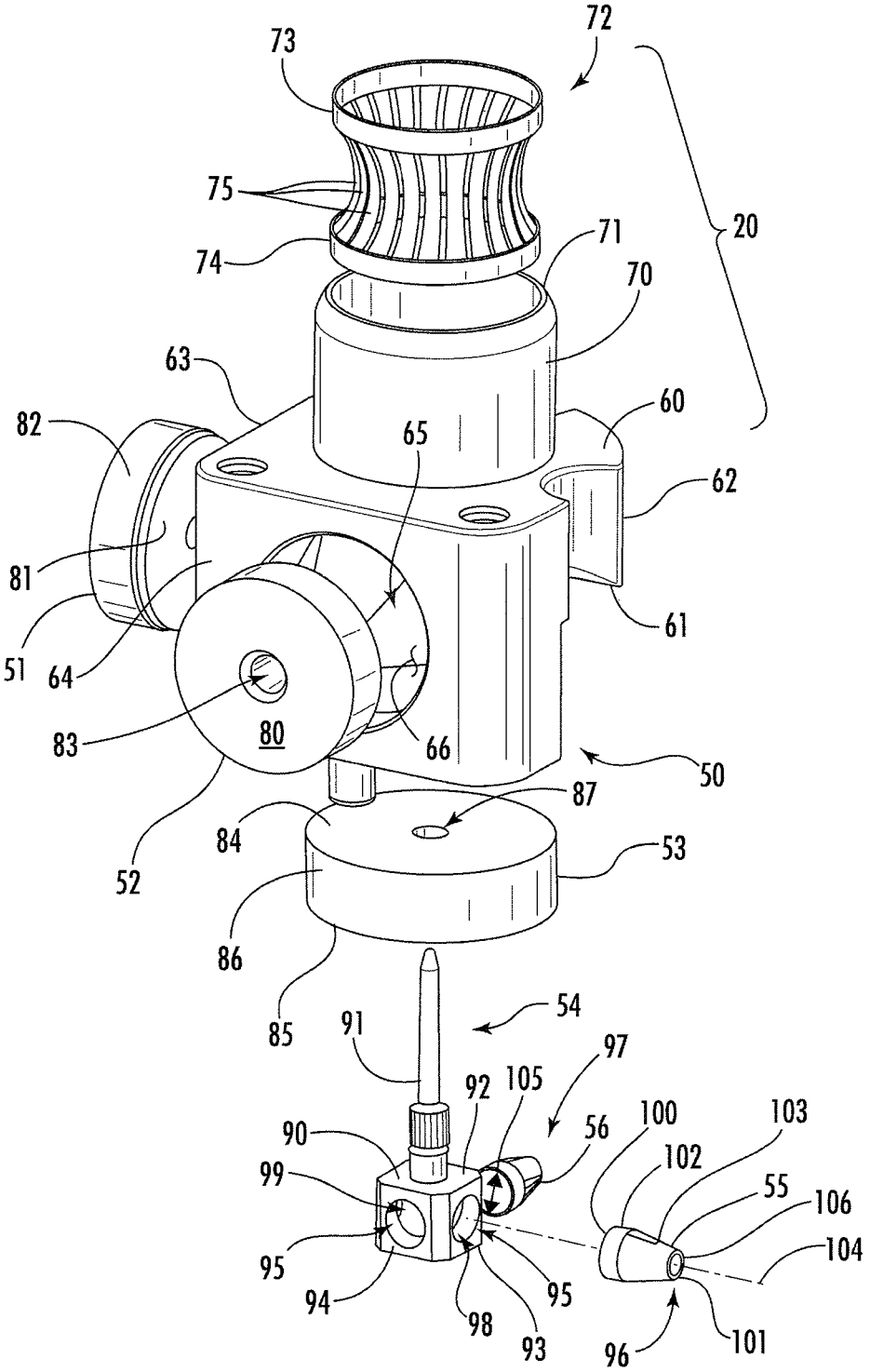
FIG. 5 is an exploded perspective view of the dual-direction connector interface.
Figure 6:
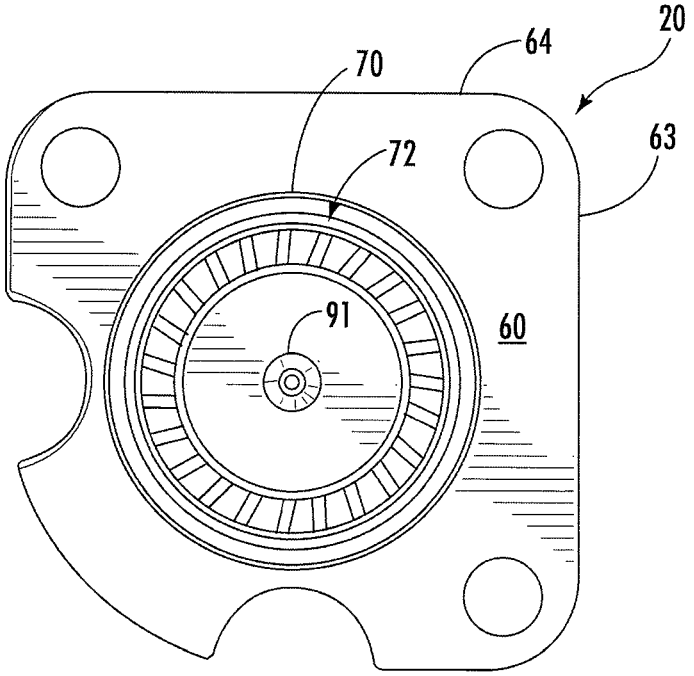
FIGS. 6-9 are top plan, bottom plan, and two side elevation views of the dual-direction connector interface, respectively.
Figure 7:
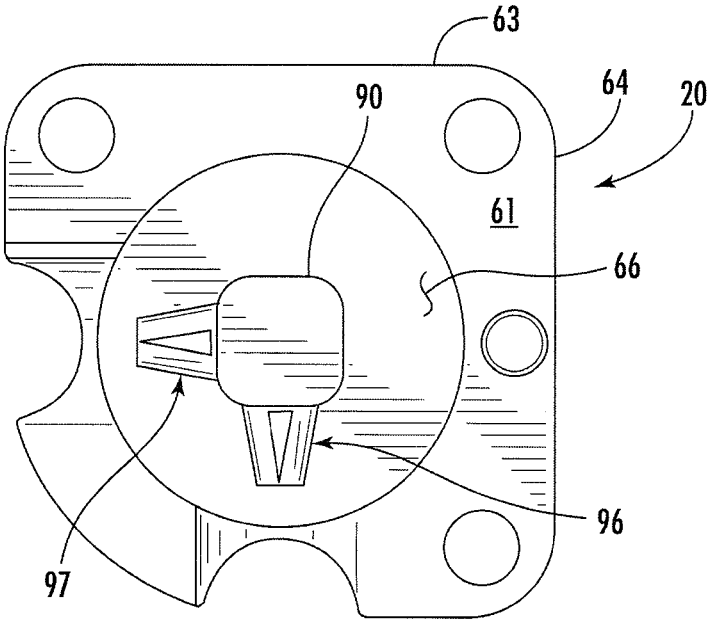
Figure 8:
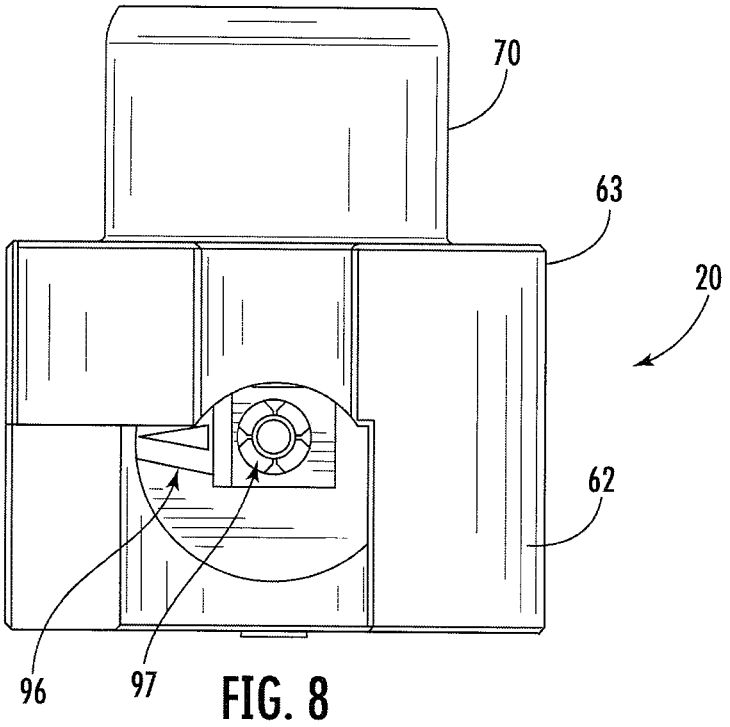
Figure 9:
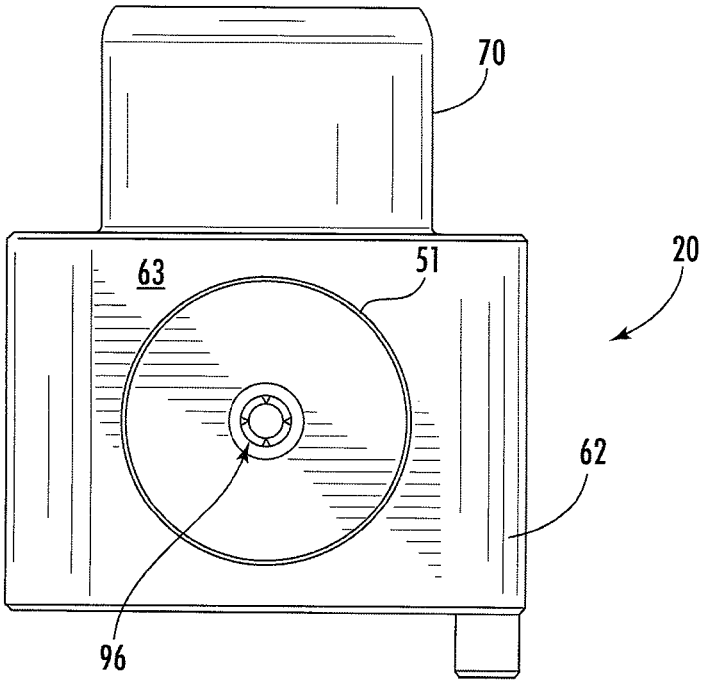

The component that allows either the pedestal or aerial connections to be used is a dual-direction connector interface or "DDCI" 20, shown in isolated, exploded view in FIG. 5. The DDCI 20 connects to the internal components of the housing 10 with a single connection, but accepts connections from either the pedestal or aerial directions. As such, the DDCI 20 provides electrical continuity between the components of the housing 20 and pedestal and aerial connections, despite the orientation thereof. Further, the DDCI 20 provides such connective flexibility across an extended range of radio frequencies.

Figure 2:
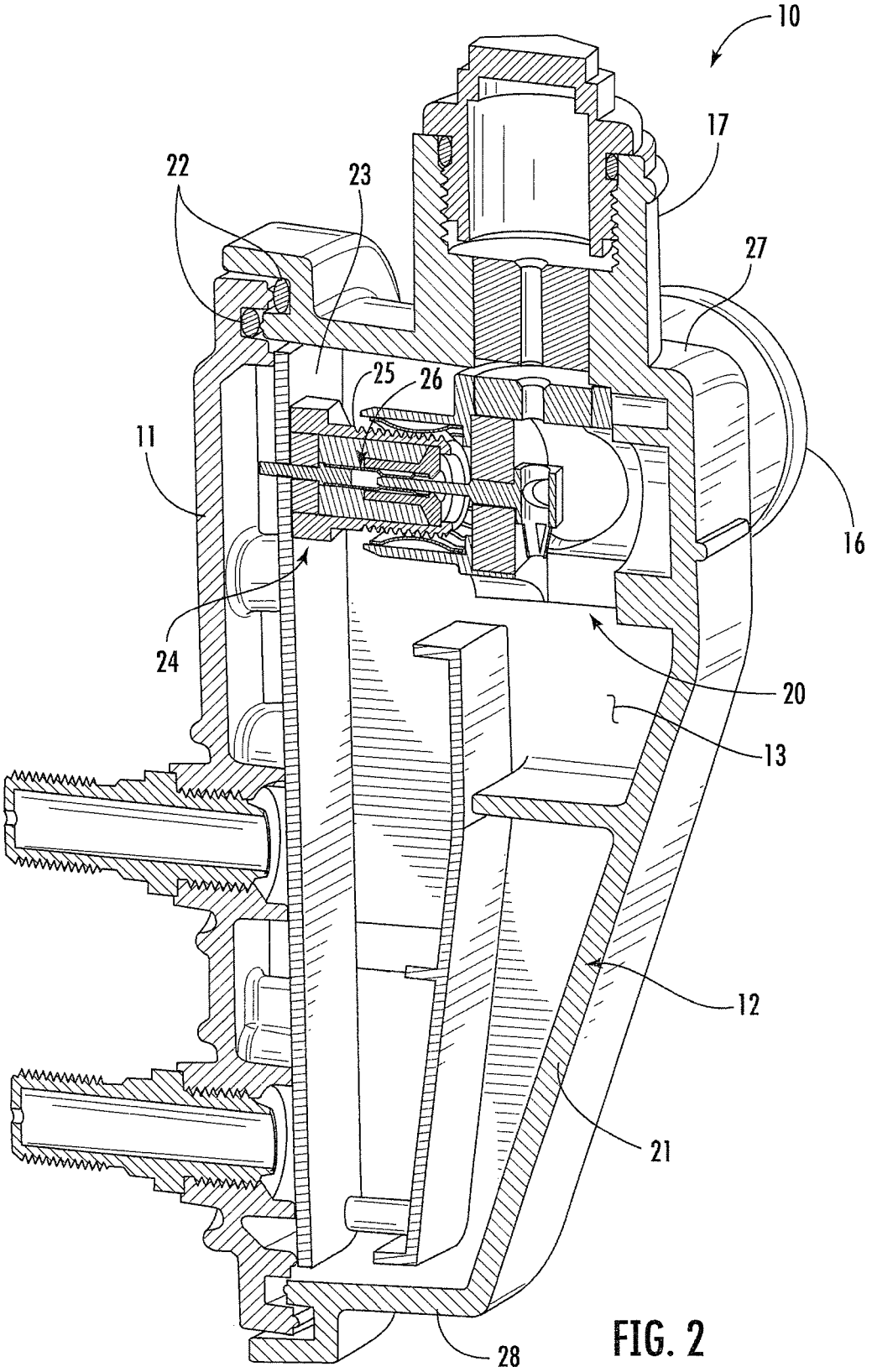
FIG. 2 is a section view of the housing and dual-direction connector interface, taken along the line 2-2 in FIG. 1.

FIG. 2 illustrates the housing 10 in section view taken along the line 2-2 of FIG. 1, depicting the interior 13 of the housing 10 and the DDCI 20 disposed therein. The backplate 12 of the housing 10 is formed from a continuous, molded sidewall 21 bounding the interior 13. The faceplate 11 and backplate 12 are coupled to each other with gaskets 22 disposed therebetween to form the environmental seal. The faceplate 11 carries a control board, printed circuit board, or "PCB" 23 which carries circuitry and programmable components. A female coaxial post 24 is also carried on the PCB 23. The post 24 extends normal to the PCB 23 and is electrically coupled thereto. It includes an outer sleeve 25 encircling a bore 26 for receiving a pin or center conductor.

The backplate 12 is mated to the faceplate 11 to form the housing 10. The housing 10 may be positioned in any orientation when installed; for convenience and clarity with respect to the drawings, the housing 10 presented here has a top 27 directed upwardly on the page and an opposed bottom 28 directed downwardly on the page. This directional labeling is made without any limitation on the structure or use of the housing 10, however. The pedestal output 17 extends from the top 27 of the housing 10; the aerial output 16 extends from the side of the housing 10 proximate the top 27. The outputs 16 and 17 are proximate each other, separated by a corner of the housing 10, because each is registered with the DDCI 20 in the interior 13 of the housing 10. Here, both the outputs 16 and 17 are shown with caps 29 fitted thereon. Gaskets are disposed between the caps 29 and the housing 10 to create a water impermeable fit ensuring an environmental seal therebetween.

Figure 3:
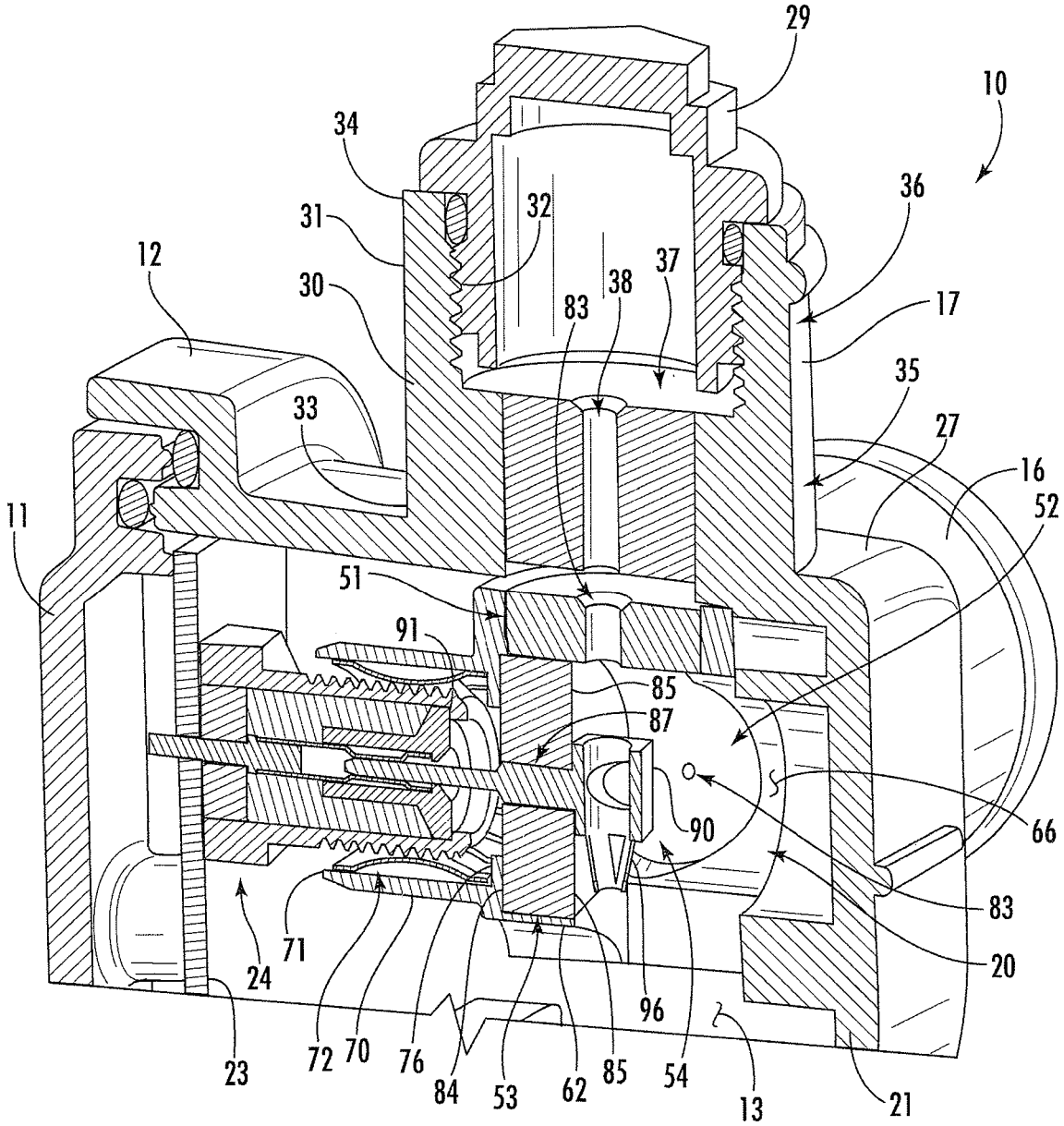
FIGS. 3 and 4 are enlarged section views taken along the line 2-2, showing steps of applying a cable to the dual-direction connector interface.

FIG. 3 is an enlarged section view of the housing 10 proximate the outputs 16 and 17. The pedestal output 17 and the aerial output 16 are identical in structure but different in location and orientation. The pedestal output 17 extends upward from the top 27 of the housing 10; the aerial output 16 extends laterally from the side of the housing 10. Otherwise, the two outputs 16 and 17 are identical, and detailed description of the aerial output 16 will not be made, as the reader will readily appreciate its structure from the below description of the structure of the pedestal output 17.

The pedestal output 17 includes a cylindrical sleeve 30 formed as an integral and monolithic extension to the sidewall of the housing 10. The sleeve 30 projects normal to the top 27. The sleeve 30 is a hollow cylinder having an outer surface 31 and an opposed inner surface 32, each extending from a base 33 of the output 17, formed at the top 17, to a free end or mating end 34 of the output 17. The sleeve 31 has two portions: a base portion 35 proximate the base 33 and an engagement portion 36 proximate the mating end 34. The inner surface 32 defines two different diameters at these two portions. In the base portion 35, the inner surface 32 defines a narrow diameter, and in the engagement portion 36, the inner surface 32 defines a wider diameter. The wider diameter inside the engagement portion 36 is sized and shaped to receive a coaxial cable connector. The narrower diameter inside the base portion 35 is sized and shaped to receive a dieletric disc 37 having a central bore 38 for receiving the center conductor extending through that coaxial cable connector. The dielectric disc 37 has a flat end located at the top of the base portion 35.

Figure 4:
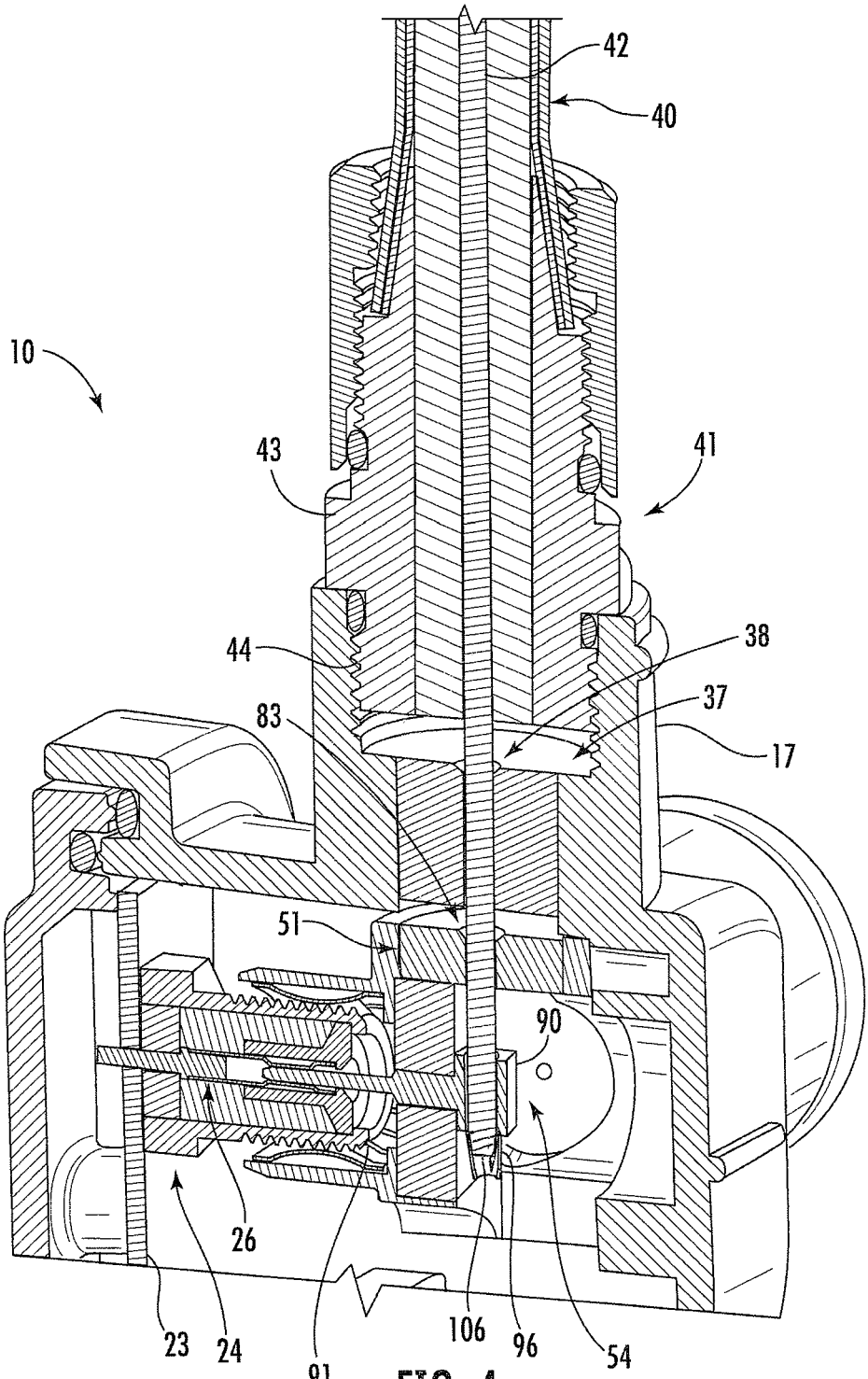

In the engagement portion 36, the inner surface 32 is, as shown in FIG. 3, preferably but not necessarily threaded, so as to receive and threadably engage with a coaxial cable connector. In FIG. 3, the cap 29 is threaded tightly onto the engagement portion 36. When the cap 29 is removed, the mating end 34 is opened and ready to receive a coaxial cable connector and the coaxial cable to which it is coupled. Briefly, FIG. 4 shows such a cable 40 and connector 41. Any suitable cable and connector may be connected to the housing 10 at the pedestal output 17; the cable illustrated in FIG. 4 includes an outer jacket, a foil layer surrounding a dielectric insulator, and a center conductor 42. The connector 41 is coupled to the prepared end of the cable 40. This connector 41 includes a single, monolithic, cylindrical sleeve 43 terminating in a threaded post 44. The dielectric and center conductor 42 extend entirely through the connector 41, with the center conductor 42 projecting beyond.

Returning to FIG. 3, the bore 38 in the dielectric disc 37 in the pedestal output 17 receives the center conductor 42 when the connector 41 is applied to the pedestal output 17; the bore 38 is registered with part of the DDCI 20 in the interior 13 of the housing 10, thereby allowing the center conductor 42, when connected to the pedestal output 17, to be connected and electrically coupled to the DDCI 20. And, as noted above, the aerial output 16 is structurally identical to the pedestal output 17; the aerial output 16 is similarly registered with part of the DDCI 20 so that a cable coupled to the aerial output 16 will also be connected and electrically coupled to the DDCI 20, albeit from a different direction.

FIG. 5 shows the DDCI 20 in exploded detail. FIGS. 6-9 also show the DDCI 20 from different views. The DDCI 20 includes a housing 50, first, second, and third dielectric bodies 51, 52, and 53 carried in the housing 50, a conducting pin 54, and first and second conductive bodies 55 and 56. The DDCI 20 electrically connects a cable 40 secured to either of the aerial and pedestal outputs 16 and 17 to the PCB 23.

The housing 50 of the DDCI 20 is a hollow body or block, generally cuboid in shape, and has opposed first and second ends 60 and 61 which are preferably but not necessarily planar, flat, and parallel to each other. A sidewall 62 extends between the first and second ends 60 and 61 and includes a flat first side 63 and a flat second side 64 transverse to and adjacent the first side 63. The first and second ends 60 and 61 are normal to the sidewall 62.

The first and second sides 63 and 64 meet at a common edge and are generally perpendicular to each other. A large circular bore 65 is formed entirely through each of the first and second sides 63 and 64. For simplicity, the bore 65 in the first side 63 is identified as a first bore 65 and the bore 65 in the second side 64 is identified as a second bore 65, though they adopt the same reference character 65. The sidewall 62 of the housing 50, together with the first and second ends 60 and 61, cooperate to bound and define an interior 66.

Formed integrally to the housing 50, a cylindrical collar 70 projects normally and outwardly from the first end 60 thereof. At the first end 60, the collar 70 is open to the interior 66 of the housing 50. At an opposed free end 71, the collar 70 is also open.

The collar 70 holds a collet or conductive sleeve insert 72. The insert 72 has an hourglass shape defined by bands 73 and 74 disposed at opposite ends of the insert 72 and a plurality of longitudinal ribs 75 extending between the bands 73 and 74 and bending inward in a concave fashion. The bands 73 and 74 have equal diameters, and the ribs 75 gradually bend inward to define an inner diameter less than that of the bands 73 and 74. The diameter of the bands 73 and 74 corresponds to the collar 70, such that the insert 72 fits snugly in the collar 70. When applied thereto, the band 74 is within the collar 70 proximate the first end 60 of the housing 50, and the band 73 is within the collar proximate the free end 71 of the collar 70. An inwardly-turned lip, seen in FIG. 3, extends inwardly from the collar 70 at the first end 60, thereby defining a stop preventing the insert 72 from being moved into the interior 66 of the housing 50.

Referring back to FIG. 5, the first and second bores 65 of the first and second sides 63 and 64 of the housing 50 snugly carry the first and second dielectric bodies 51 and 52, respectively. The bodies 51 and 52 are identical, and only one is described here, with the understanding that the description applies equally to the other, using the same reference characters. The dielectric body 51 is disc-shaped, having a planar, circular outer surface 80 directed away from the housing 50 and a planar, circular inner surface 81 directed into the interior 66. Between the outer and inner surfaces 80 and 81 is a solid body 82 formed from a material having electrically insulative or dielectric characteristics. A cylindrical bore 83 is formed centrally entirely through the body 82, from the outer surface 80 to the inner surface 81 in a direction normal to both surfaces 80 and 81. The first and second dielectric bodies 51 and 52 are held snugly in the housing 50, and the first and second bores 83 of the first and second bodies 51 are aligned with each other and are registered with a geometric center of the housing 50.

The third dielectric body 53 is carried in the housing 50. The body 53 is also disc-shaped and also has planar, circular first and second surfaces 84 and 85 with a solid body 86 therebetween formed from a material having electrically insulative or dielectric characteristics. A cylindrical bore 87 is formed centrally entirely through the body 86, from the first surface 84 to the second surface 85 in a direction normal to both surfaces 84 and 85. The third dielectric body 53 is held in the interior 66 of the housing 50. Referring briefly to FIG. 3, the disposition of the third dielectric body 53 in the interior 66 is shown: the first surface 84 is in abutting contact with the lip 76 of the housing 50, with the insert 72 on the other side of the lip 76. The second surface 85 does not extend so far into the interior 66 as to block the bores 83 of either the first or second dielectric bodies 52.

Referring back to FIG. 5, the conducting pin 54 is carried within the housing 50. The conducting pin 54 extends from the interior 66 of the housing 50 into the collar 70. The conducting pin 54 has an enlarged head 90 and a slender shank 91 extending therefrom. The head 90 is a cube with a top 92, bottom 93, and four sides 94. The shank 91 is integrally and monolithically formed to the top 92. The head 90 is hollow, and each of the sides 94 is formed with a circular bore 95. The bores 95 in opposing sides form pairs, such that there are two pairs of bores 95 disposed in offset orientations, perpendicular to each other. One of the bores 95 in each pair holds one of a first and second conductive bodies 96 and 97. Between each pair of bores 95 is defined a channel: a first channel 98 extending between one pair of bores 95 and an offset second channel 99 extending between the other pair of bores 95. The first channel 98 is registered with the bore 83 in the first dielectric body 51, and the second channel 99 is registered with the bore 83 in the second dielectric body 52. The first and second channels 98 and 99 intersect each other.

The first and second conductive bodies 96 and 97 are identical in every respect, and so only the first conductive body 96 is described here, with the understanding that the description applies equally to the other, second conductive body 97. The same reference characters are used for the same structural elements and features of each of the first and second conductive bodies 96 and 97. The first conductive body 96 is generally conical; it extends and tapers from an open proximal end 100 to an open distal end 101. A base ring 102 is at the proximal end 100; the base ring 102 is thin, short, and hollow, defining the opening at the proximal end 100. A hollow cone 103 extends monolithically away from the base ring 102, tapering in diameter from that of the base ring 102. The first conductive body 96 is constructed from a single piece of conductive material, such as copper, iron, aluminum, or other metal. A conical passage 104 extends axially through the first conductive body 96, as indicated by the axial line in FIG. 5. When the first conductive body 96 is carried in the bore 95 in the head 90 of the conducting pin 54, and the conducting pin 54 is disposed inside the housing 50, the passage 104 (or "first passage") is registered with the bore 83 in the first dielectric body 51. Likewise, because they are identical, when the second conductive body 97 is carried in its respective bore 95 in the head 90 of the conducting pin 54, and the conducting pin 54 is disposed inside the housing 50, the passage 104 (or "second passage") is registered with the bore 83 in the second dielectric body 52. As such, when the cable 40 and connector 41 are connected to either the aerial or pedestal outputs 16 and 17, the center conductor 42 extends entirely through the respective first or second dielectric body 51 or 52 and through the respective first or second passage 104 of the respective first or second conductive body 96 or 97. The center conductor 42 thus makes electrical contact with the first or second conductive body 96 and 97.

Continuing the description of the first conductive body 96 with the understanding that the description still applies to the second conductive body 97, the first conductive body 96 has an inner diameter 105 (shown better on the second conductive body 97 with the same reference character 105). The inner diameter 105 is constant across the base ring 102, but tapers or decreases from the base ring 102 to the distal end 101. In this way, the first conductive body 96 is suitable for accommodating and receiving in full contact center conductors 42 of differing outer diameters; as a center conductor 42 is advanced through the passage 104 in the first conductive body 96, the inner diameter decreases until the center conductor 42 encounters an inner surface 106 of the first conductive body 96 is prevented from moving further. Indeed, the first conductive body 96 has a circular cross-section at all points along its length between the proximal end 100 and the distal end 101. When a center conductor 42 is applied to the first conductive body, and the center conductor 42 has a circular cross-section, the entirety of the outer perimeter or outer surface, along a cross-section of the center conductor 42, is in contact with the entirety of the inner surface 106 of the first conductive body 96. In this way, a continuous ring of contact is established between the center conductor 42 and the first conductive body 96, which provides a reliable and high performing electrical connection between the center conductor 42 and the DDCI 20 between at least 5 MHz and 3 GHz. Likewise, the second conductive body 97 performs similarly.

The first conductive body 96 is carried in the bore 95 shown on the "right side" of the head 90, as it is shown in FIG. 5. The conducting pin 54 has rotational symmetry about an axis extending through the shank 91, so the use of "right side" is for clarity of the description only and is not meant to limit the description in any way. The base ring 102 is snug fit into the bore 95, so that the proximal end 100 is directed toward the first dielectric body 51 and distal end 101 is directed away from the first dielectric body 51. In this way, the first conductive body 96 is a contiguous extension of the first channel 98 in the head 90. The cone 103 extends laterally outward from the base ring 102, such that the passage 104 is normal to the side 94 in which that bore 95 is formed. Similarly, the base ring 102 of the second conductive body 97 is snug fit into the bore 95 on the "back side" of the head 90, as it is shown in FIG. 5, with the cone 103 of the second conductive body 97 extending laterally outward therefrom, such that the passage 104 of the second conductive body 97 is normal to the side 94 in which that respective bore 95 is formed. The first and second conductive bodies 96 and 97 are thus offset in perpendicular alignments to each other (as shown most clearly in FIG. 7), aligned with but opposite from the first and second dielectric bodies 51 and 52.

From the top 92 of the head 90, the shank 91 extends: the shank 91 is slender, straight, and tapers slightly to a tip. The shank 91, like the head 90 and the first and second conductive bodies 96 and 97, is electrically conductive. When a center conductor 42 is connected to either of the first and second conductive bodies 96 and 97, and an electrical signal is transmitted through the center conductor 42, that signal passes into the first or second conductive body 96 or 97, into the head 91, and then down the shank 91. When the DDCI 20 is properly installed in the housing 10, that shank 91 is applied in the bore 26 of the coaxial post 24 on the PCB 23, and so the signal is transmitted to the PCB 23 effectively.

The conducting pin 54 is held in a suitable orientation for such application into the third dielectric body 53. With reference now to FIG. 3, the third dielectric body 53 is snugly disposed in the interior 66 of the housing 50, held against the lip 76 of housing 50, between the sidewall 62 of the housing and the first and second dielectric bodies 51 and 52. The shank 91 of the conducting pin 54 is applied through the central bore 87 of the third dielectric body 53 until the base of the shank 91 (proximate the head 90) is fully seated in the bore 87, and the head 90 itself is received in seated contact against the second surface 85 of the third dielectric body 53. The bore 87 holds the conducting pin 54 in this correct position, ready for application into the coaxial post 24.

In this position, as seen in FIG. 3, the head 90 of the conducting pin 54 is disposed in the interior 66 of the housing 50, and the shank 91 of the conducting pin 54 extends into the collar 70. The shank 91 extends almost to the free end 71 of the collar 70. The shank 91 is encircled by the collar 70 and the insert 72 applied thereto. Thus, the collar 70, insert 72, and conducting pin 54 define an engagement assembly for engaging with the coaxial post 24 of the PCB in electrical contact.

Figure 10:
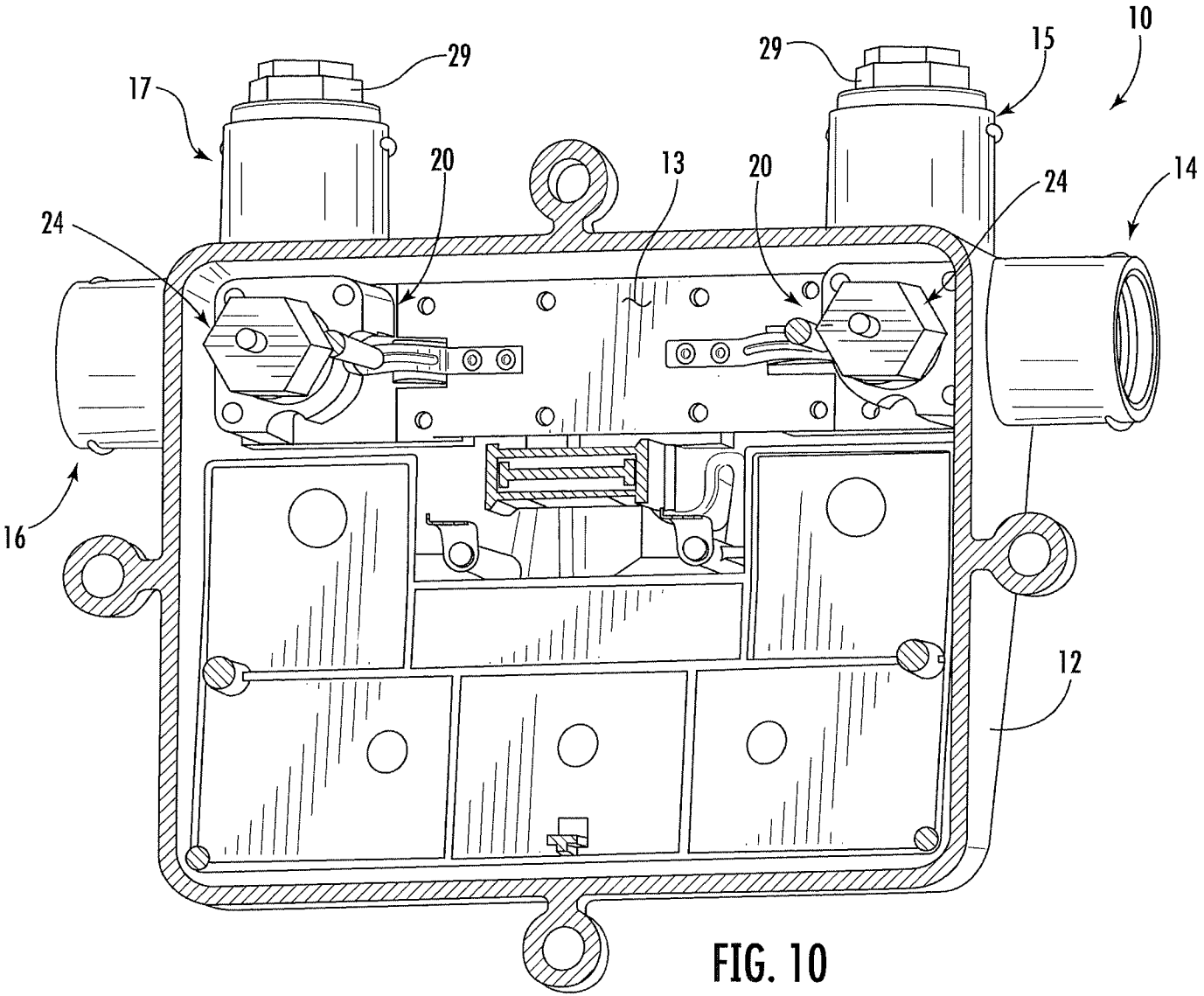
FIGS. 10 and 11 are section views of the housing taken along the line 10-10 in FIG. 1.
Figure 11:
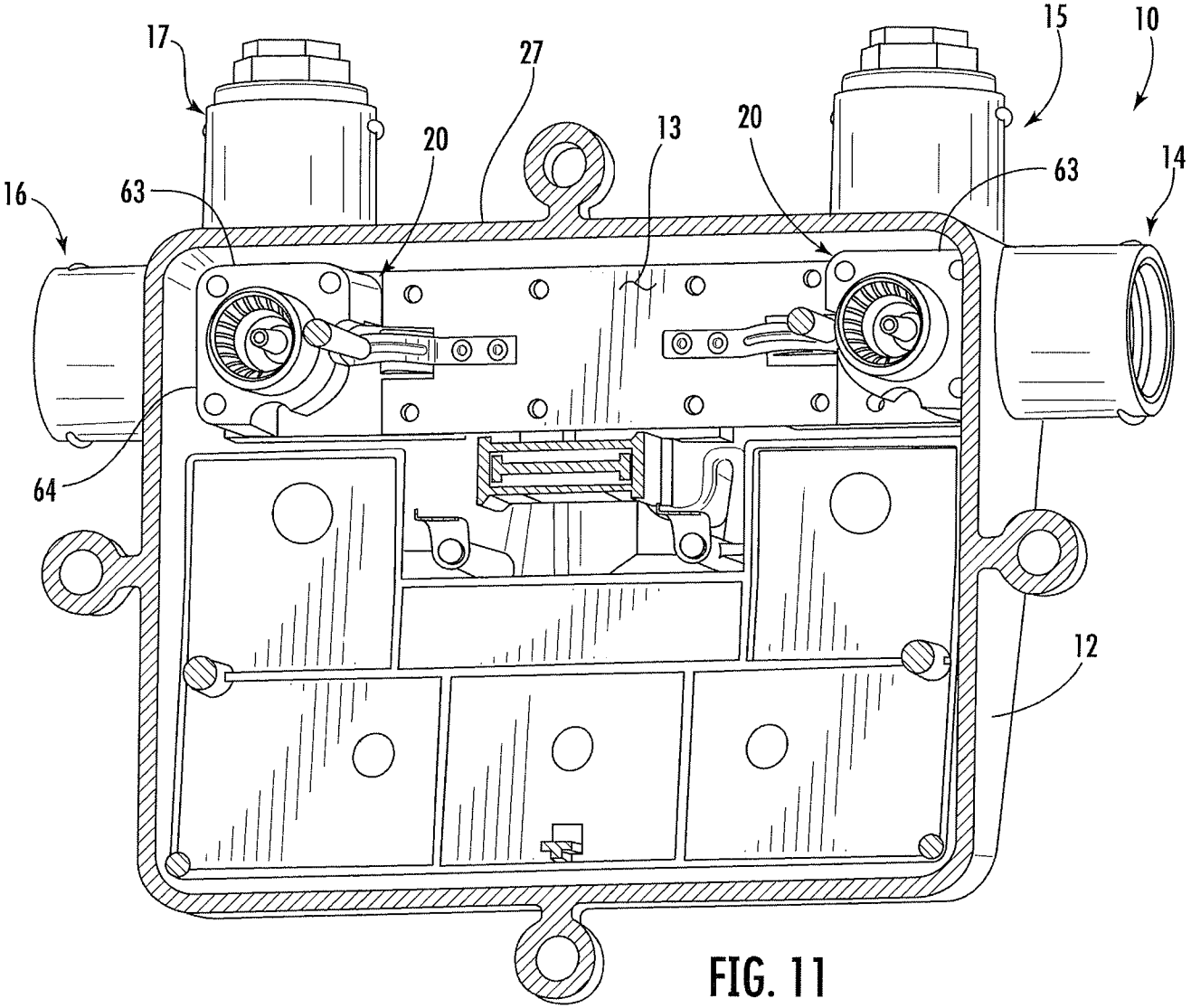

FIGS. 10 and 11 show the housing 10 in partial section view along the line 10-10 of FIG. 2. These views show the interior 13 of the housing 10 and the components carried therein. The PCB 23 is not visible, as it is on the other side of the section line. In FIG. 10, however, the coaxial posts 24 projecting from the PCB 23 are shown, while in FIG. 11, the coaxial posts 24 are hidden to better show the DDCI 20.

FIG. 10 shows that the coaxial posts 24 and the DDCIs 20 are coaxially aligned and registered with each other. FIG. 11 shows the open collars 70 and inserts 72 therein, ready and available for application to the coaxial posts 24. The coaxial posts 24 are carried on the PCB 23, which is mounted on the faceplate 11, while the DDCIs 20 are mounted on the backplate 12. When the faceplate 11 and backplate 12 are brought together to form the housing 10, the DDCIs are applied over the coaxial posts 24 to couple them in electrical and radio frequency communication.

As can be seen in FIG. 11, the two DDCIs 20 in the top-left and top-right corners are identical but opposite: each has a first side 63 directed upward toward the top 27 of the housing 10. The first sides 63 are directed toward the pedestal input 15 and pedestal output 17, and the second sides 64 are directed toward the aerial input 14 and aerial output 16.

Indeed, the first dielectric bodies 51 carried in the first sides 63 are registered and coaxially aligned with the pedestal input and output 15 and 17, such that the bores 38 in the dielectric discs 37 in the pedestal input and output 15 and 17 are registered and coaxially aligned with the bores 83 in the first dielectric bodies 51 so as to allow a center conductor 42 to pass through the bores 38 and 83 without interruption. Similarly, the second dielectric bodies 52 carried in the second sides 64 are registered and coaxially aligned with the aerial input 14 and aerial output 16, such that the bores 38 in the dielectric discs 37 in the aerial input and output 14 and 16 are registered and coaxially aligned with the bores 83 in the second dielectric bodies 52 so as to allow a center conductor 42 to pass through the bores 38 and 83 without interruption.

In this way, as noted above, a technician can connect an upstream coaxial cable 40 into either of the aerial or pedestal inputs 14 or 15, passing the center conductor 42 into the proximate DDCI 20 and the respective first or second conductive body 96 or 97 in the head 90 of the conducting pin 54, to couple the housing 10 to the upstream cable 40 without exceeding the bend radius of the cable 40. And further, the technician can connect a downstream coaxial cable 40 into either of the aerial or pedestal outputs 16 or 17, passing the center conductor 42 into the proximate DDCI 20 and the respective first or second conductive body 96 or 97 in the head 90 of the conducting pin 54, to couple the housing 10 to the downstream cable 40 without exceeding the bend radius of the cable 40.

Referring now finally to FIGS. 3 and 4, these section views show installation of such a cable 40 into the pedestal output 17. In FIG. 3, the cap 29 is engaged with the pedestal output 17, forming an environmental seal keeping water, moisture, and other environmental elements out. The cap 29 is threadably removed from the pedestal output 17.

A cable 40 is prepared by cutting or pulling back the jacket and foil layer and then fitting a connector 41 on the exposed dielectric. The center conductor 42 is left long. The cable 40, fit with the connector 41, is then registered with and advanced toward the open pedestal output 17. The center conductor 42 is passed through the bore 38 in the dielectric disc 37, thereby aligning the center conductor 42 with the bore 83 in the first dielectric body 51 and with the first conductive body 96 in the head 90 of the conducting pin 54. The cable 40 is then advanced, causing the center conductor 42 to enter the head 90, until the center conductor 42 is lodged in snug contact with the inner surface 106 of the first conductive body 96. In this arrangement, the continuous ring of contact is established between the center conductor 42 and the first conductive body 96. The cable 40 is then secured on the pedestal output 17 by threading the connector 41 to the threads on the inner surface 32 of the pedestal output 17.

When a signal is transmitted through the cable 40, that signal passes through the center conductor 42 to the first conductive body 96 and head 91 of the conducting pin 54, then through the shank 92 of the conducting pin 54 into the bore 26 of the coaxial post 24. In some embodiments, the bore 26 is fit with a conductive sleeve, and the signal is transmitted through that sleeve into the PCB 23; in other embodiments, the bore 26 is electrically connected directly to the PCB, and the signal is thus transmitted directly to the PCB 23. In this way, signal is transmitted from the cable 40 to the PCB 23 for processing and further transmission.

A preferred embodiment is fully and clearly described above so as to enable one having skill in the art to understand, make, and use the same. Those skilled in the art will recognize that modifications may be made to the description above without departing from the spirit of the specification, and that some embodiments include only those elements and features described, or a subset thereof. To the extent that modifications do not depart from the spirit of the specification, they are intended to be included within the scope thereof.

What is claimed is:

1. A dual direction connector interface comprising:

a housing having first and second sides transverse to each other;

first and second dielectric bodies carried in the first and second sides, respectively, and having first and second bores formed therethrough, respectively;

a conducting pin carried within the housing, the conducting pin having a head and a shank;

first and second conductive bodies carried on the head of the conducting pin, and having first and second passages, respectively, formed therein for receiving a center conductor of a coaxial cable; and the first and second passages are registered with the first and second bores, respectively.

2. The dual direction connector interface of claim 1, wherein the first and second conductive bodies are conical.

3. The dual direction connector interface of claim 1, wherein:

the first conductive body has a proximal end directed toward the first dielectric body, a distal end directed away from the first dielectric body, and an inner diameter which decreases from the proximal end to the distal end of the first conductive body; and the second conductive body has a proximal end directed toward the second dielectric body, a distal end directed away from the second dielectric body, and an inner diameter which decreases from the proximal end to the distal end the second conductive body.

4. The dual direction connector interface of claim 1, wherein:

the head of the conducting pin has a first channel and a second channel registered with the first and second dielectric bodies, respectively; and the first and second conductive bodies are contiguous extensions of the first and second channels, respectively.

5. The dual direction connector interface of claim 4, wherein the first and second channels intersect.

6. The dual direction connector interface of claim 1, further comprising a third dielectric body having a third bore formed therethrough, wherein the conducting pin extends through the third bore.

7. The dual direction connector interface of claim 1, wherein the housing includes:

a first end, and a sidewall carrying the first and second dielectric bodies, wherein the first end and the sidewall cooperate to define an interior of the housing in which the head of the conducting pin is disposed; and a collar extending laterally from the first end, the collar carrying a conductive sleeve insert for engaging with a coaxial post.

8. The dual direction connector interface of claim 7, wherein the conductive sleeve insert has an hourglass shape.

9. The dual direction connector interface of claim 7, further comprising:

a third dielectric body having a third bore formed therethrough; and the conducting pin extends through the third bore such that the head of the conducting pin is disposed in the interior of the housing and the shank of the conducting pin extends into the collar.

10. A dual direction connector interface comprising:

a housing having first and second sides transverse to each other, for receiving a center conductor through one of the first and second sides;

a conducting pin carried within the housing, the conducting pin having a head and a shank; and first and second conductive bodies carried on the head of the conducting pin, and having first and second conical passages, respectively, formed therein for receiving the center conductor, wherein the first and second passages are registered with the first and second sides, respectively.

11. The dual direction connector interface of claim 10, wherein the first and second conductive bodies are conical.

12. The dual direction connector interface of claim 10, wherein:

the first conductive body has a proximal end directed toward the head, a distal end directed away from the head, and an inner diameter which decreases from the proximal end to the distal end of the first conductive body; and the second conductive body has a proximal end directed toward the head, a distal end directed away from the head, and an inner diameter which decreases from the proximal end to the distal end of the second conductive body.

13. The dual direction connector interface of claim 10, wherein the head of the conducting pin has a first channel and a second channel registered with the first and second conductive bodies, respectively, which are contiguous extensions of the first and second channels, respectively.

14. The dual direction connector interface of claim 13, wherein the first and second channels intersect.

15. The dual direction connector interface of claim 10, wherein the housing includes:

a first end and a sidewall cooperating to define an interior of the housing in which the head of the conducting pin is disposed; and a collar extending laterally from the first end, the collar carrying a conductive sleeve insert for engaging with a coaxial post.

16. The dual direction connector interface of claim 15, wherein the conductive sleeve insert has an hourglass shape.

17. The dual direction connector interface of claim 16, further comprising:

a dielectric body in the housing and having a bore formed therethrough; and the conducting pin extends through the bore such that the head of the conducting pin is disposed in the interior of the housing and the shank of the conducting pin extends into the collar.

18. An RF device comprising:

a device housing formed from a faceplate secured to a backplate;

a control board carried within the device housing, the control board having a coaxial post extending therefrom;

a connection assembly on the device housing comprising first and second connections oriented transverse with respect to each other; and a dual direction connector interface within the device housing, comprising a conducting pin electrically coupled to the coaxial post, wherein the conducting pin has a head on which are carried first and second conductive conical bodies registered with the first and second connections, respectively.

19. The RF device of claim 18, further comprising:

first and second sides of the dual direction connector interface which are transverse to each other;

first and second dielectric bodies carried in the first and second sides, respectively, and having first and second bores formed therethrough, respectively; and the first and second conductive bodies have first and second passages which are registered with the first and second bores, respectively.

20. The RF device of claim 19, wherein:

the head of the conducting pin has a first channel and a second channel registered with the first and second dielectric bodies, respectively; and the first and second conductive bodies are contiguous extensions of the first and second channels, respectively.

* * * * *